US006368171B1

(12) United States Patent
Fuller et al.

(10) Patent No.: US 6,368,171 B1
(45) Date of Patent: Apr. 9, 2002

(54) FLOTATION DEVICE COVER

(76) Inventors: Dan Fuller; Cheryl K. Fuller, both of 1335 Villa Park, Louisville, KY (US) 40219

( * ) Notice: Subject to any disclaimer, the term of this patent is extended or adjusted under 35 U.S.C. 154(b) by 0 days.

(21) Appl. No.: 09/610,750

(22) Filed: Jul. 6, 2000

Related U.S. Application Data

(60) Provisional application No. 60/142,771, filed on Jul. 8, 1999.

(51) Int. Cl.[7] ..... B63B 35/58
(52) U.S. Cl. ..... 441/40; 441/129
(58) Field of Search ..... 441/35, 40, 129, 441/130, 131, 132

(56) References Cited

U.S. PATENT DOCUMENTS

| | | | | | |
|---|---|---|---|---|---|
| 1,110,614 | A | | 9/1914 | Edmonds | |
| 1,262,989 | A | | 4/1918 | Silvernail | |
| 1,332,673 | A | * | 3/1920 | Marshall | 441/129 |
| 2,018,548 | A | | 10/1935 | Currey | |
| 2,036,548 | A | | 4/1936 | Silvernail | |
| 2,850,252 | A | | 9/1958 | Ford | |
| 4,317,244 | A | | 3/1982 | Balfour-Richie | |
| 4,913,672 | A | * | 4/1990 | Martin | 441/40 |
| 5,006,087 | A | | 4/1991 | Peterson | |
| 5,388,293 | A | | 2/1995 | Kistner | |
| 5,560,056 | A | | 10/1996 | Tai | |
| 5,855,498 | A | | 1/1999 | Spector | |
| 6,066,016 | A | * | 5/2000 | Yonover | 441/40 |

* cited by examiner

*Primary Examiner*—Stephen Avila
(74) *Attorney, Agent, or Firm*—Stites & Harbison, PLLC; David W. Nagle, Jr.

(57) ABSTRACT

The present invention relates to a fabric cover for encasing a flotation device. Loops are attached to the cover along the periphery of the cover to allow the user to secure additional flotation devices or anchors to the cover. The covering is preferably made from porous fabric that dries rapidly, that is relatively impervious to exposure to sunlight, saline solutions, and aqueous chlorine solutions and that has a "soft" feel against the user's skin.

2 Claims, 4 Drawing Sheets

FLOTATION DEVICE COVER

CROSS-REFERENCE TO RELATED APPLICATION

This application claims priority from U.S. Provisional Application Ser. No. 60/142,771, filed Jul. 8, 1999, which application is incorporated herein by reference in its entirety.

BACKGROUND

The present development relates to a fabric cover for encasing a flotation device. The cover includes means for securing optional attachments, such as anchoring pouches, to the device.

Flotation devices, such as air mattresses and foam floats, are commonly used in swimming pools, lakes, and at other water recreation facilities. The user lays on the upper surface of the device while the device floats on the surface of the water. Typically, the user is clothed in a swimsuit, sun-suit, or shorts, and thus, significant portions of the user's skin is in direct contact with the flotation device. In order for the flotation device to function properly, the device has to retain air within its skin, or exterior shell, and prohibit permeation of water through the skin. To meet these requirements, the device usually has a skin made from plastic, vinyl, or a similar air and water impermeable material. When this impermeable material gets hot, such as when exposed to the sun for an extended period of time, the material can become uncomfortable next to the user's skin. Further, flotation devices are designed to move freely along the surface of the water. While this may be desirable in a swimming pool or small pond, it can be disconcerting for the user if the floatation device is carried too far from the shore at an ocean or large lake.

Cloth covered floating devices, per se, are not unknown. For example, U.S. Pat. No. 1,110,614 describes a life saving mattress made from a standard fabric filled mattress wrapped in a water-proof casing, then further wrapped in an outer cover. The cover preferably includes features to ensure that the mattress is held taut within a frame so that the mattress cannot sag and water cannot pool on the upper surface of the mattress. However, for recreational use, the user typically want at least a thin layer of water to reach the surface of the device because of the cooling benefits provided to the user from the water. In U.S. Pat. No. 1,262,989, air-tight inflatable tubes are packed within multiple layers of fabric casings to create a floating device. The multiple fabric layers provide protection for the tubes, but require that the user remove the tubes and turn the cover inside out for thorough drying. More recently, covers have been designed for inflatable mattresses to convert the mattresses from recreational use items to sleeping devices. For example, U.S. Pat. No. 4,317,244 describes a cover for an air mattress that uses a plurality of layers of material for the cover and that includes a side wall assembly, so that when the air mattress is inserted in the cover it appears similar to a standard bed mattress. To use the mattress in the water, the mattress must be removed from the cloth shell, leaving the uncomfortable water impermeable surface of the mattress exposed.

Thus, it would be desirable to have a cover designed to fit over a flotation device that would make the device more comfortable against the user's skin, that would dry quickly when the flotation device was removed from the water—even with the device remaining within the cover, that would be sufficiently flexible that the flotation device could function as though the cover was not present; and that could allow the user to anchor the flotation device—if so desired—so the device could remain in a limited area rather than floating freely.

SUMMARY OF THE INVENTION

The present invention relates to a fabric cover for encasing a flotation device, or air mattress, having a skin made from an air and water impermeable material, with the cover including attachment sites for anchoring devices. The cover has at least one opening to allow the flotation device to be inserted within the cover. The opening optionally includes closure means, such as Velcro strips, for securing the device within the cover. Loops are attached to the cover along the periphery of the cover to allow the user to secure additional flotation devices or anchors to the cover. The covering is preferably made from a porous fabric that dries rapidly, that is relatively impervious to exposure to sunlight, saline solutions, and aqueous chlorine solutions, and that has a "soft" feel against the user's skin.

DETAILED DESCRIPTION OF A PREFERRED EMBODIMENT

Figure 1:
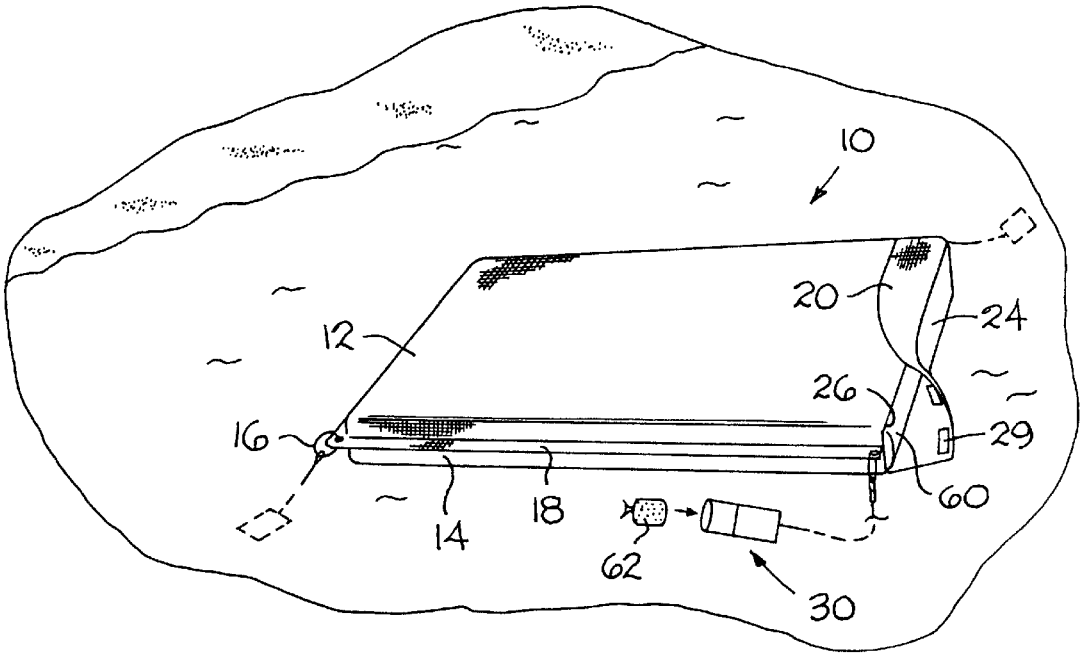
FIG. 1 is a perspective view of a flotation device cover made in accordance with the present invention, shown with a flotation device inserted in the cover, and with the optional pouches, shown containing sand, attached to the cover.
Figure 2:
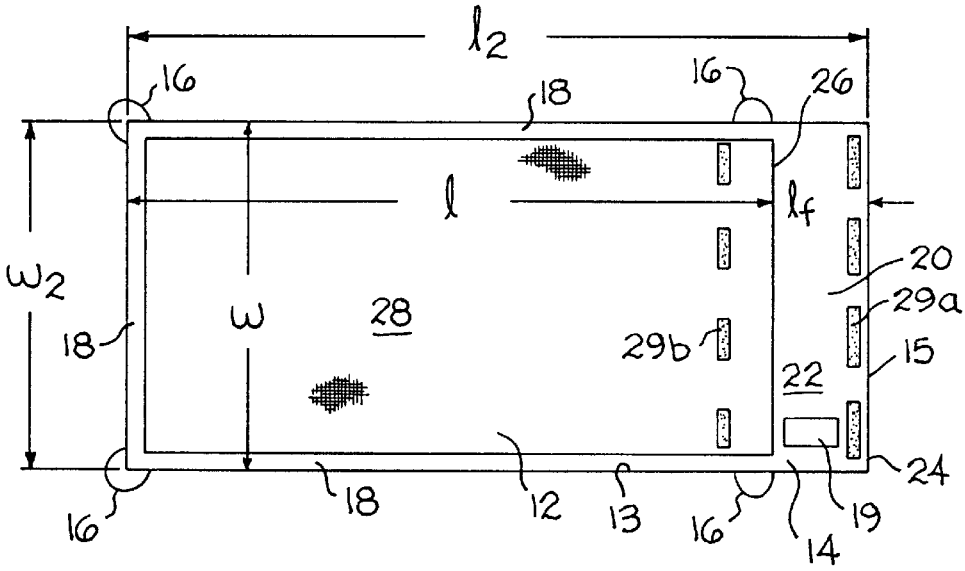
FIG. 2 is a top view of the flotation device cover of FIG. 1.

FIGS. 1 and 2 show an embodiment of the flotation device cover 10 of the present invention. As shown in FIG. 1, a flotation device 60 can be inserted into the cover 10, and pouches 30 may be attached to the cover 10. The pouches 30 can include fillers 62, such as anchoring materials or additional floating devices. For example, on a beach the pouches 30 may be filled with sand and can then be attached to the cover 10. The sand-filled pouches 30 will anchor the cover 10 and flotation device 60 in place, preventing the cover 10 and device 60 from floating into the sea or lake, from blowing away in a stiff breeze, or even from drifting too far in a swimming pool or small pond.

The cover 10 has as key elements a first piece of fabric 12, having a periphery 13; a second piece of fabric 14, having a periphery 15; and at least one anchoring loop 16. Preferably, the first piece 12 and second piece 14 of fabric are made from a porous material that dries rapidly, that is relatively impervious to exposure to sunlight, saline solutions, and aqueous chlorine solutions, and that has a "soft" feel against the user's skin, such as low denier cotton, low denier polyester, Spandex®, or a combination thereof. The loop 16 is preferably made from a relatively inelastic material, such as nylon cord or braid.

The fabric pieces 12, 14 can be of any contour and dimension suitable to completely encase the desired flotation device 60. The pieces 12, 14 are joined at the peripheries 13, 15 by a seam 18, leaving an open edge 26 through which the flotation device 60 can be inserted. Two part reversible fasteners 29*a*, 29*b*, such as Velcro® strips, snaps, buttons and buttonholes, nylon zippers, or a combination thereof, are used to close the opening 26 after the flotation device 60 is inserted so that the device 60 cannot freely exit the cover 10. The loops 16 are formed by securing both ends of a piece of cord to the first piece 12 of fabric, or to the second piece 14 of fabric, or to some combination thereof, such that a void space remains between the cord and the fabric.

In a preferred embodiment, shown in FIG. 2, the cover 10 is made from the first piece of fabric 12 having an essentially rectangular shape, with a length "l " and width "w". The second piece of fabric 14 also has an essentially rectangular shape, with a width "$W_2$" essentially the same as the width "w" of the first piece 12, but with a length "$l_2$" that is longer than the first piece by a flap distance "$l_f$". The first piece 12 is joined to the second piece 14 along three edges by the seam 18, such that the peripheries 13, 15 coincide along the seamed edges. The fourth edge of the first piece 12 is not joined to the second piece 14, thereby leaving the opening 26 at the interface of the two pieces 12, 14, through which a flotation device 60 can be inserted. Because the second piece 14 is longer than the first piece 12 by the distance "$l_f$", a flap 20 is formed when the first and second pieces 12, 14 are joined by the seam 18. The flap 20 has an inner face 22 which faces toward the first piece 12, and an outer face 24. After the flotation device 60 is inserted into the cover 10 through the opening 26, as shown in FIG. 1, the flap 20 is folded so as to cover the opening 26. To keep the flap 20 from re-opening when the flotation device 60 is inserted, two part reversible fasteners 29, such as Velcro® strips, snaps, buttons and buttonholes, or a combination thereof, can be used. One part of each fastener 29*a* is attached to the inner face 22 of the flap 20 along the periphery 15 and the second part of the fastener 29*b* is attached to the exterior surface 28 of the first piece of fabric 12. The second part of the fastener 29*b* is positioned on the first piece of fabric 12 such that when the flap 20 is closed, the two parts of the fastener 29*a*, 29*b* can be easily joined. The loops 16 are formed by securing both ends of a piece of cord to the first piece 12 of fabric, or to the second piece 14 of fabric, or to some combination thereof, such that a void space remains between the cord and the fabric. In a preferred embodiment, a plurality of loops 16 having a length "c" of approximately "4" are formed by securing the ends of a piece of cord within the seam 18. Optionally, a pocket 19 may be attached to the flap 20 to hold small items, such as keys or a wallet. The pocket 19 may include a protective liner, or a closure device, or both, but neither the liner nor the closure device are required on the pocket 19.

Figure 4:
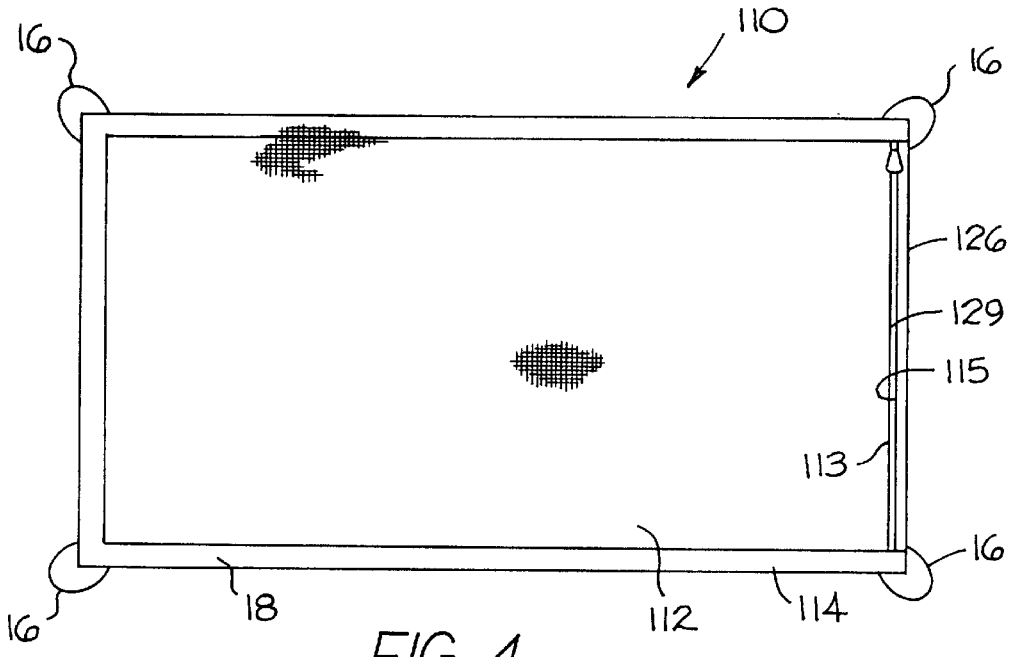
FIG. 4 is a top view of a first alternative embodiment of a flotation device cover made in accordance with the present invention.

In a first alternative embodiment, shown in FIG. 4, the cover 110 is similar to the cover 10 of FIGS. 1 and 2 except that the first and second pieces 112, 114 of fabric have essentially identical dimensions. Thus, there is no excess fabric to form a flap to cover the opening 126. In this embodiment, the fasteners 129 are attached along the peripheries 113, 115 of the fabric pieces 112, 114 adjacent to the opening 126. A preferred fastener 129 for this embodiment is a nylon zipper, although any fastener which will hold the opening 126 closed enough to retain the flotation device 60 within the cover 110 may be used, including for example a drawstring. To use the cover 110, the flotation device 60 is inserted into the cover 110 through the opening 126 and the fastener 129 is closed.

Figure 4A:
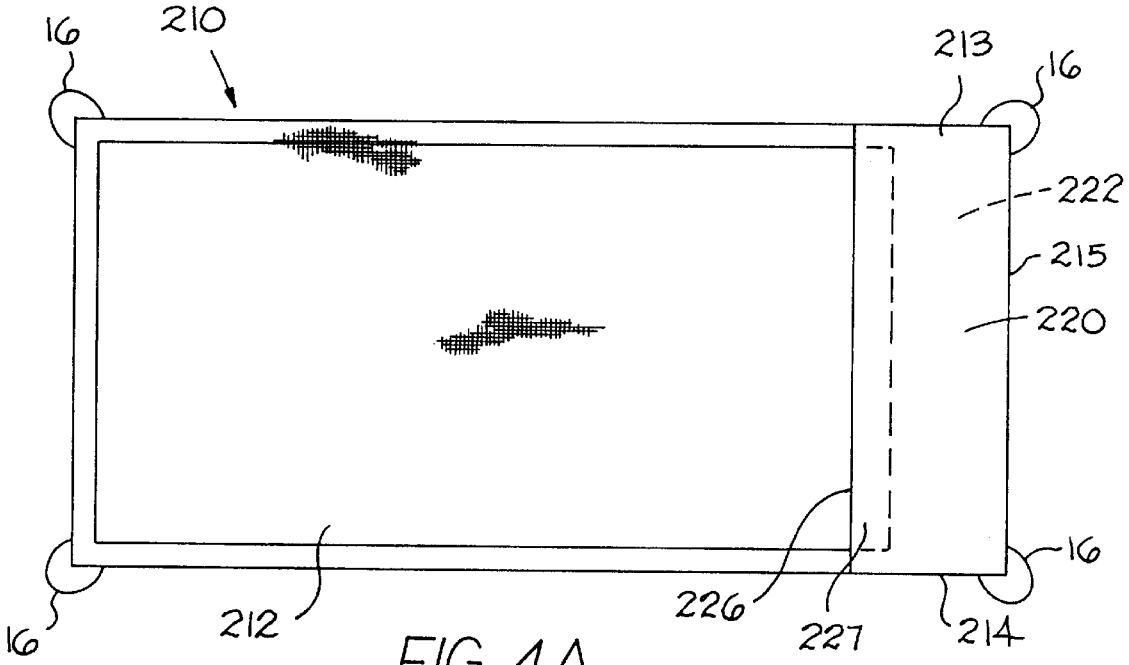
FIG. 4A is a top view of a first alternative embodiment of a flotation device cover made in accordance with the present invention.

A second alternative embodiment of the cover 210 is shown in FIG. 4A. The cover 210 is similar to the cover 10 of FIGS. 1 and 2, except that a third piece of fabric 213 is attached to the second piece of fabric 214 along the periphery 215. The third piece of fabric 213 essentially covers the inner face 222 of the flap 220, and creates a slight overlap 227 with the first piece of fabric 212 (the overlap 227 is exaggerated in the figure for illustrative purposes, and may be much narrower). The float 60 can be inserted into the cover 210 through the opening 226 that remains between the first and third fabric pieces 212, 213. No additional fasteners are required, but they may be included if desired by the user, and may include any common fasteners, such as snaps, Velcro®, hook-and-eye units, drawstrings, or the like.

Figure 3:
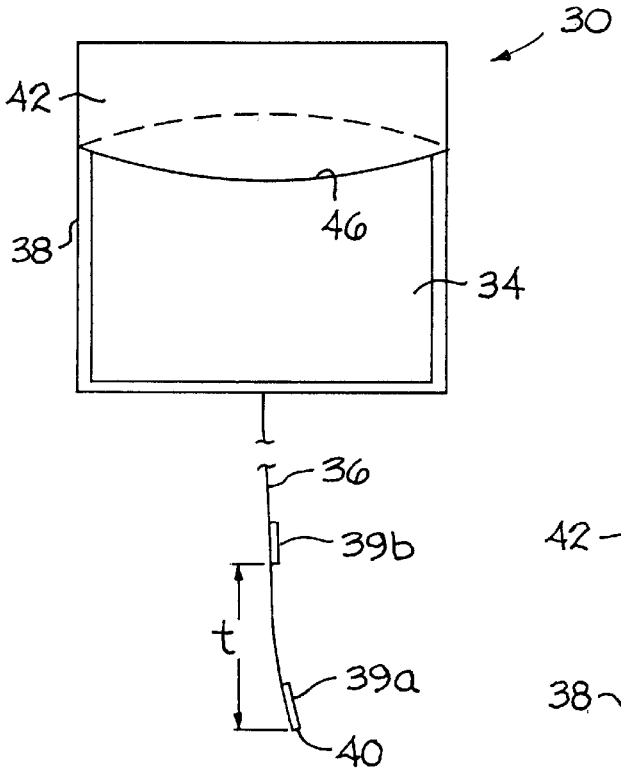
FIG. 3 is a front view of the pouch of FIG. 1.

An optional pouch, generally being a smaller version of a flotation cover, can be used in conjunction with the covers 10, 110, 210 of the present invention. For example, FIGS. 1 and 3 show an embodiment of an optional pouch 30 that is made from a first piece 32 of material having an edge 33, joined to a second piece 34 of material having an edge 35, along three sides by a seam 38, leaving an opening 46 at one end of the pouch 30. In a preferred embodiment, the pouch 30 is essentially a smaller version of the flotation cover 10, except that the pouch 30 has a strap 36 instead of loops 16. Similar to the cover 10, the pouch 30 may include a flap 42 that can be used to close the opening 46. Fasteners (not shown) may be used to hold the flap 42 closed. The strap 36 is preferably made from a relatively inelastic material, such as nylon cord or braid, and one end is attached to the pouch 30, preferably at the seam 38. Attached to the strap 36 is a two part reversible fastener 39, such as strips of Velcro®, a snap, button and buttonhole, or a combination thereof. One part of each fastener 39*a* is attached to a free end 40 of the strap 36 and the second part of the fastener 39*b* is attached to the strap 36 at a predetermined distance "t" from the free end 40. When the pouch is used with the cover 10, the free end 40 of the strap 36 is fed through the loop 16, and the fastener 39*a*, 39*b* is closed, thereby forming intersecting loops that reversibly join, or hold, the pouch 30 to the cover 10. Alternatively, the two part fastener 39 may be replaced by a self-closing hook (not shown) attached to the free end 40 of the strap 36. In use, the hook can be linked directly to the loop 16, thereby holding the pouch 30 to the cover 10.

Similar to the cover 10, the pouch 30 can hold a flotation device, and float on the water's surface. Alternatively, the pouch 30 can be used to hold sand or a similar heavily weighted material. In this situation, the pouch 30 would function as an anchor when attached to the cover 10. The pouch 30 can be made from the same porous materials as the cover 10, and may further include a liner, such as a plastic sheet. When the plastic liner is added, the sand is less likely to seep from the pouch 30 through the pores in the material, but the liner is not required for the pouch 30 to function as intended.

Figure 3A:
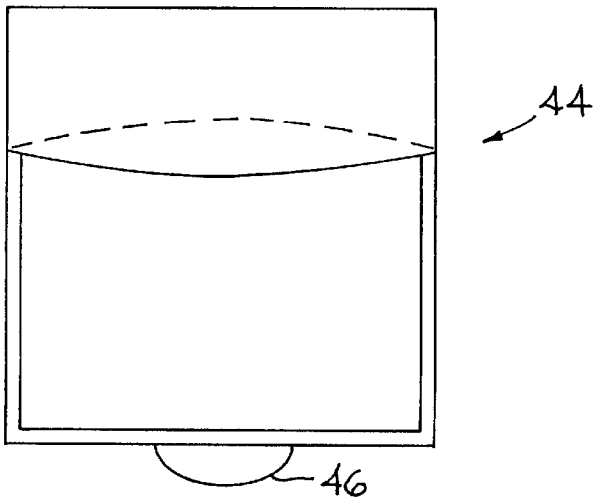
FIG. 3A is a front view of a first alternative embodiment of the pouch of FIG. 1.

In a first alternative embodiment of the pouch 44, shown in FIG. 3A, the pouch is identical to the pouch 30 of FIG. 3 except that an attachment loop 46 is secured to the pouch 44, and the strap (not shown) is a separate unit from the pouch 44. The strap can be similar to the strap shown, or can be a linking device that will allow the user to reversibly connect the pouch 44 to the cover 10, preferably by linking one end of the device to the pouch loop 46 and the opposing end to the cover loop 16.

Figure 5:
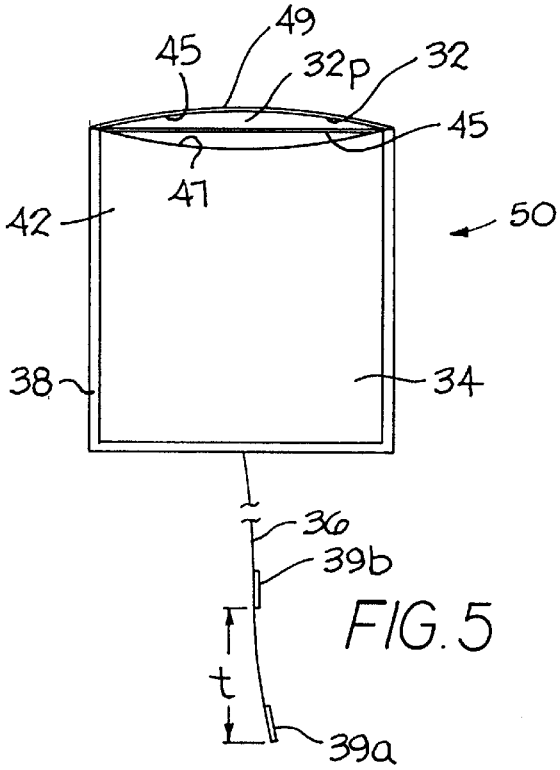
FIG. 5 is a front view of a second alternative embodiment of a pouch made in accordance with the present invention.

In a second alternative embodiment of the pouch 50, as shown in FIG. 5, a third piece of fabric 48, having dimensions essentially identical to the first piece 32 of fabric, is positioned between the first 32 and second 34 pieces of fabric, and is secured to the first and second pieces 32, 34 through the seam 38. This creates first and second pockets

45, 47, which can be closed by fastening means. In a preferred embodiment of the pouch 50, the first, second, and third pieces 32, 34, 48 of fabric are made of material that includes a plastic lining on one face of the fabric. The pieces 32, 34, 48 are layered so that the plastic lined face on the first and third 32*p*, 48*p* pieces are adjacent, and the plastic lined face on the second piece 34*p* is adjacent to the third piece 48. The pieces are secured together along three edges at the periphery by the seam 38. A fastener 49, such as a zip-lock fastening device, is attached to the open edge of the first pocket 45 formed by the first and third pieces 32, 48 of fabric. A second fastener 51, such as Velcro® strips, nylon snaps, or a combination thereof, can optionally be attached to the open edge of the second pocket 47 between the second and third 34, 48 pieces of fabric. Having two pockets allows the user to store small personal items, such as keys or a wallet, in the first pocket 45, and to insert a flotation device in the second pocket 47. The pouch 50 can be attached to the cover 10 by the strap 36 so the user can keep the personal items in his immediate proximity even while using the flotation device 60 in the water.

Figure 6:
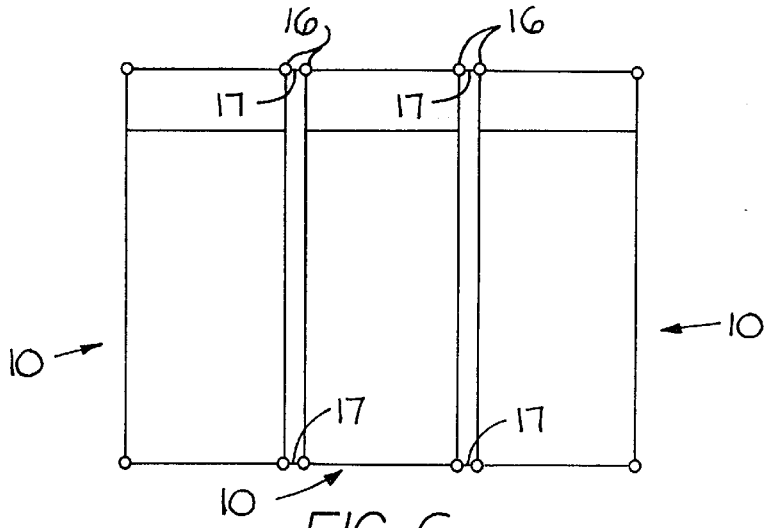
FIGS. 6 and 6A are top views of multiple flotation devices linked together by the anchoring loops.
Figure 6A:
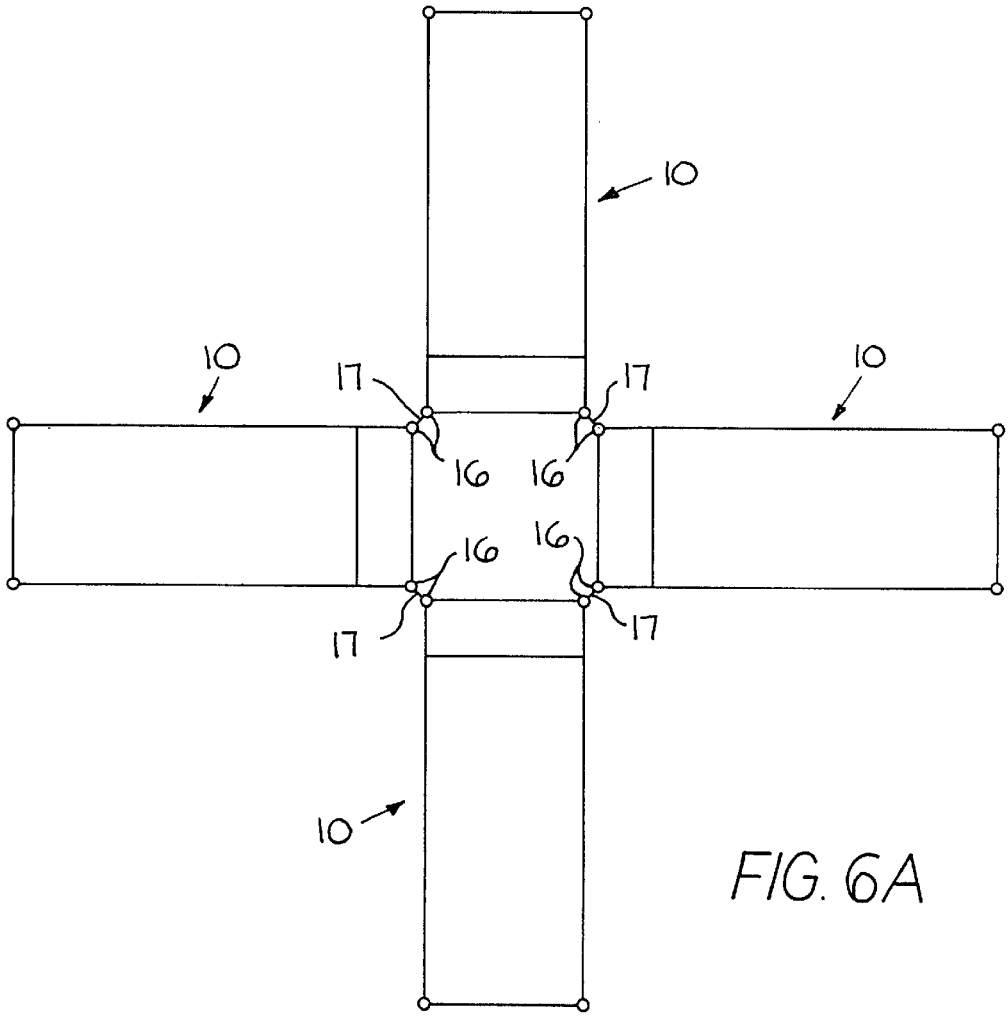

As shown in FIGS. 6 and 6A, the anchoring loops 16 can also be used to link two or more covers 10 together. Any appropriate linker 17, such as hooks, string, cord, clasps, and the like, can be used.

It will be obvious to those skilled in the art that modifications may be made to the embodiments described above without departing from the scope of the present invention.

What is claimed is:

1. A porous fabric cover for a flotation device, said cover comprising:

a) a first piece of fabric, having a periphery;

b) a second piece of fabric, having a periphery, joined to said first piece of fabric along the periphery, and leaving an open edge through which the flotation device can be inserted into the cover;

c) a reversible two part fastener, a first part of sail fastener being secured to said first piece of fabric near the open edge and a second part of said fastener being secured to said second piece of fabric near the open edge, such that the first part can be joined to the second part to effectively close the open edge preventing the flotation device from exiting the cover;

d) at least one anchoring loop, securely attached to said first piece of fabric; and e) a pouch, capable of holding objects and adapted to be reversibly secured to said cover, said pouch including:

(i) a first piece of material, having an edge, (ii) a second piece of material, having an edge, joined to said first piece of material such that the edges coincide, and leaving an open edge, (iii) at least one attachment loop, securely attached to said first piece of material, and (iv) a linking device adapted to interact with said anchoring loop and said attachment loop such that said pouch is reversibly joined to said cover.

2. A porous fabric cover for a flotation device, said cover comprising:

(a) a first piece of fabric, having a periphery;

(b) a second piece of fabric, having a periphery, joined to said first piece of fabric along the periphery, and leaving an open edge through which the flotation device can be inserted into the cover;

(c) a reversible two part fastener, a first part of said fastener being secured to said first piece of fabric near the open edge and a second part of said fastener being secured to said second piece of fabric near the open edge, such that the first part can be joined to the second part to effectively close the open edge preventing the flotation device from exiting the cover;

(d) at least one anchoring loop, securely attached to said first piece of fabric; and (e) a pouch capable of holding objects and adapted to be reversibly secured to said cover, said pouch including:

(i) a first piece of material, having an edge;

(ii) a second piece of material, having an edge, joined to said first piece of material such that the edges coincide, and leaving an open edge; and (iii) at least one strap, securely attached to said first piece of material, said strap being adapted to interact with said anchoring loop such that said pouch is reversibly joined to said cover.

* * * * *